US008632278B2

(12) United States Patent
Taylor

(10) Patent No.: US 8,632,278 B2
(45) Date of Patent: Jan. 21, 2014

(54) MECHANICALLY STABILIZED EARTH WELDED WIRE FACING CONNECTION SYSTEM AND METHOD

(75) Inventor: Thomas P. Taylor, Colleyville, TX (US)

(73) Assignee: T & B Structural Systems LLC

( * ) Notice: Subject to any disclaimer, the term of this patent is extended or adjusted under 35 U.S.C. 154(b) by 610 days.

(21) Appl. No.: 12/837,347

(22) Filed: Jul. 15, 2010

(65) Prior Publication Data

US 2011/0311314 A1 Dec. 22, 2011

Related U.S. Application Data

(63) Continuation-in-part of application No. 12/818,011, filed on Jun. 17, 2010.

(51) Int. Cl.

| | |
|---|---|
| ***E21D 20/00*** | (2006.01) |
| ***E21D 21/00*** | (2006.01) |
| ***E02D 29/00*** | (2006.01) |

(52) U.S. Cl.

USPC ..... 405/262; 405/284; 405/302.4

(58) Field of Classification Search

USPC ..... 405/262, 284, 258.1, 302.4, 302.6, 405/302.7

See application file for complete search history.

(56) References Cited

U.S. PATENT DOCUMENTS

| | | | | |
|---|---|---|---|---|
| 991,041 | A | 5/1911 | Toennes | |
| RE13,299 | E | 10/1911 | Denison | |
| 1,012,008 | A * | 12/1911 | Post | 403/46 |
| 1,144,143 | A * | 6/1915 | McGillivray | 405/20 |
| 1,813,912 | A | 7/1931 | Clark | |
| 1,959,816 | A | 5/1934 | Crum | |
| 1,992,785 | A | 2/1935 | Steuer | |
| 2,137,153 | A | 11/1938 | Brozek | |
| 2,208,589 | A | 7/1940 | Leemhuis | |
| 2,275,933 | A | 3/1942 | Werner | |
| 2,316,712 | A | 4/1943 | Prince | |
| 2,327,640 | A | 8/1943 | Hendry | |
| 2,552,712 | A | 5/1951 | Ellis | |

(Continued)

FOREIGN PATENT DOCUMENTS

| | | |
|---|---|---|
| EP | 427221 A | 5/1991 |
| EP | 0679768 | 2/1995 |

(Continued)

OTHER PUBLICATIONS

International Application No. PCT/US08/69011—International Search Report and Written Opinion dated Oct. 10, 2008.

(Continued)

*Primary Examiner* — Frederick L Lagman
*Assistant Examiner* — Patrick Lambe
(74) *Attorney, Agent, or Firm* — Edmonds & Nolte, PC

(57) ABSTRACT

A system and method of constructing a mechanically stabilized earth (MSE) structure. A wire facing is composed of horizontal and vertical elements. A soil reinforcing element has a plurality of transverse wires coupled to at least two longitudinal wires where the longitudinal wires are coupled to a coil and a threaded rod is configured to extend through both the vertical facing and the coil. A washer engages the vertical facing and prevents the threaded rod from passing completely through the vertical facing and a nut is threaded onto the threaded rod to prevent its removal from the coil. Multiple systems can be characterized as lifts and erected one atop the other to a desired MSE structure height.

19 Claims, 4 Drawing Sheets

(56) References Cited

U.S. PATENT DOCUMENTS

| | | | | | |
|---|---|---|---|---|---|
| 2,703,963 | A | | 3/1955 | Gutierrez | |
| 2,881,614 | A | | 4/1959 | Preininger | |
| 3,316,721 | A | * | 5/1967 | Heilig | 405/262 |
| 3,597,928 | A | | 8/1971 | Pilaar | |
| 3,680,748 | A | * | 8/1972 | Brunhuber | 223/98 |
| 3,998,022 | A | | 12/1976 | Muse | |
| 4,075,924 | A | | 2/1978 | McSherry | |
| 4,116,010 | A | | 9/1978 | Vidal | |
| 4,117,686 | A | | 10/1978 | Hilfiker | |
| 4,123,881 | A | | 11/1978 | Muse | |
| 4,134,241 | A | | 1/1979 | Walton | |
| 4,193,718 | A | * | 3/1980 | Wahrendorf et al. | 405/286 |
| 4,286,895 | A | | 9/1981 | Poli | |
| 4,324,508 | A | | 4/1982 | Hilfiker | |
| 4,329,089 | A | * | 5/1982 | Hilfiker et al. | 405/262 |
| 4,341,491 | A | | 7/1982 | Neumann | |
| 4,343,572 | A | * | 8/1982 | Hilfiker | 405/284 |
| 4,391,557 | A | | 7/1983 | Hilfiker | |
| 4,411,255 | A | | 10/1983 | Lee | |
| 4,470,728 | A | | 9/1984 | Broadbent | |
| 4,505,621 | A | * | 3/1985 | Hilfiker et al. | 405/284 |
| 4,514,113 | A | | 4/1985 | Neumann | |
| 4,616,959 | A | | 10/1986 | Hilfiker | |
| 4,643,618 | A | | 2/1987 | Hilfiker | |
| 4,651,975 | A | | 3/1987 | Howell | |
| 4,653,962 | A | | 3/1987 | McKittrick | |
| 4,661,023 | A | | 4/1987 | Hilfiker | |
| 4,664,552 | A | | 5/1987 | Schaaf | |
| 4,710,062 | A | | 12/1987 | Vidal | |
| 4,725,170 | A | * | 2/1988 | Davis | 405/286 |
| 4,834,584 | A | | 5/1989 | Hilfiker | |
| 4,856,939 | A | * | 8/1989 | Hilfiker | 405/284 |
| 4,914,876 | A | | 4/1990 | Forsberg | |
| 4,929,125 | A | * | 5/1990 | Hilfiker | 405/262 |
| 4,952,098 | A | | 8/1990 | Grayson | |
| 4,961,673 | A | | 10/1990 | Pagano | |
| 4,968,186 | A | | 11/1990 | Ogorchock | |
| 4,993,879 | A | * | 2/1991 | Hilfiker | 405/262 |
| 5,044,833 | A | * | 9/1991 | Wilfiker | 405/267 |
| 5,066,169 | A | | 11/1991 | Gavin | |
| 5,076,735 | A | | 12/1991 | Hilfiker | |
| 5,139,369 | A | | 8/1992 | Jaecklin | |
| 5,156,496 | A | | 10/1992 | Vidal | |
| 5,190,413 | A | | 3/1993 | Carey | |
| 5,207,038 | A | | 5/1993 | Negri | |
| RE34,314 | E | | 7/1993 | Forsberg | |
| 5,242,249 | A | * | 9/1993 | Grayson | 405/286 |
| 5,257,880 | A | | 11/1993 | Janopaul | |
| 5,259,704 | A | * | 11/1993 | Orgorchock | 405/262 |
| 5,407,303 | A | * | 4/1995 | Manns | 405/262 |
| 5,417,523 | A | | 5/1995 | Scales | |
| 5,451,120 | A | | 9/1995 | Martinez-Gonzalez | |
| 5,456,554 | A | | 10/1995 | Barrett | |
| 5,474,405 | A | | 12/1995 | Anderson | |
| D366,191 | S | | 1/1996 | Gay | |
| 5,484,235 | A | * | 1/1996 | Hilfiker et al. | 405/284 |
| 5,487,623 | A | | 1/1996 | Anderson | |
| 5,494,379 | A | | 2/1996 | Anderson | |
| 5,507,599 | A | | 4/1996 | Anderson | |
| 5,522,682 | A | | 6/1996 | Egan | |
| 5,525,014 | A | * | 6/1996 | Brown | 405/262 |
| 5,531,547 | A | * | 7/1996 | Shimada | 405/262 |
| 5,533,839 | A | | 7/1996 | Shimada | |
| 5,568,998 | A | * | 10/1996 | Egan et al. | 405/262 |
| 5,582,492 | A | * | 12/1996 | Doyle, Jr. | 405/262 |
| 5,622,455 | A | | 4/1997 | Anderson | |
| 5,658,096 | A | * | 8/1997 | Von Kanel | 405/302.4 |
| 5,702,208 | A | | 12/1997 | Hilfiker | |
| 5,722,799 | A | * | 3/1998 | Hilfiker | 405/262 |
| 5,730,559 | A | | 3/1998 | Anderson | |
| 5,733,072 | A | * | 3/1998 | Hilfiker et al. | 405/284 |
| D393,989 | S | | 5/1998 | Groves | |
| 5,749,680 | A | * | 5/1998 | Hilfiker et al. | 405/262 |
| 5,797,706 | A | * | 8/1998 | Segrestin et al. | 405/262 |
| 5,807,030 | A | | 9/1998 | Anderson | |
| 5,820,305 | A | | 10/1998 | Taylor | |
| 5,947,643 | A | * | 9/1999 | Anderson et al. | 405/262 |
| 5,951,209 | A | * | 9/1999 | Anderson et al. | 405/262 |
| 5,962,834 | A | * | 10/1999 | Markman | 235/385 |
| 5,965,467 | A | * | 10/1999 | Stevenson et al. | 442/218 |
| 5,971,699 | A | | 10/1999 | Winski | |
| 5,975,809 | A | | 11/1999 | Taylor | |
| 5,975,810 | A | | 11/1999 | Taylor | |
| 6,024,516 | A | | 2/2000 | Taylor | |
| 6,050,748 | A | | 4/2000 | Anderson | |
| 6,079,908 | A | * | 6/2000 | Anderson | 405/262 |
| 6,086,288 | A | * | 7/2000 | Ruel et al. | 405/262 |
| D433,291 | S | | 11/2000 | Shamoon | |
| 6,186,703 | B1 | * | 2/2001 | Shaw | 405/262 |
| 6,280,121 | B1 | * | 8/2001 | Khamis | 405/284 |
| 6,336,773 | B1 | * | 1/2002 | Anderson et al. | 405/262 |
| 6,345,934 | B1 | * | 2/2002 | Jailloux et al. | 405/262 |
| 6,357,970 | B1 | * | 3/2002 | Hilfiker et al. | 405/302.7 |
| 6,517,293 | B2 | * | 2/2003 | Taylor et al. | 405/302.4 |
| 6,565,288 | B1 | * | 5/2003 | McCallion | 405/259.5 |
| 6,595,726 | B1 | * | 7/2003 | Egan et al. | 405/284 |
| 6,675,547 | B1 | * | 1/2004 | Golcheh | 52/741.13 |
| 6,793,436 | B1 | * | 9/2004 | Ruel et al. | 403/316 |
| 6,802,675 | B2 | * | 10/2004 | Timmons et al. | 405/284 |
| 6,854,236 | B2 | * | 2/2005 | Bott | 52/609 |
| 6,857,823 | B1 | * | 2/2005 | Hilfiker et al. | 405/262 |
| 6,874,975 | B2 | * | 4/2005 | Hilfiker et al. | 405/262 |
| 6,939,087 | B2 | * | 9/2005 | Ruel | 405/286 |
| 7,033,118 | B2 | * | 4/2006 | Hilfiker | 405/262 |
| 7,073,983 | B2 | * | 7/2006 | Hilfiker et al. | 405/262 |
| 7,270,502 | B2 | | 9/2007 | Brown | |
| 7,281,882 | B2 | * | 10/2007 | Hilfiker et al. | 405/262 |
| 7,399,144 | B2 | * | 7/2008 | Kallen | 405/284 |
| D599,630 | S | | 9/2009 | Taylor | |
| 7,708,503 | B2 | * | 5/2010 | Kohel et al. | 405/302.7 |
| 7,722,296 | B1 | * | 5/2010 | Taylor | 405/262 |
| 7,891,912 | B2 | | 2/2011 | Taylor | |
| 7,972,086 | B2 | | 7/2011 | Taylor | |
| 7,980,790 | B2 | | 7/2011 | Taylor | |
| 8,079,782 | B1 | * | 12/2011 | Hilfiker et al. | 405/262 |
| 2002/0044840 | A1 | | 4/2002 | Taylor | |
| 2002/0067959 | A1 | | 6/2002 | Thornton | |
| 2003/0213203 | A1 | * | 11/2003 | Bott et al. | 52/603 |
| 2003/0223825 | A1 | | 12/2003 | Timmons | |
| 2004/0018061 | A1 | | 1/2004 | Jannsson | |
| 2004/0161306 | A1 | * | 8/2004 | Ruel | 405/284 |
| 2004/0179902 | A1 | | 9/2004 | Ruel | |
| 2005/0111921 | A1 | * | 5/2005 | Taylor et al. | 405/262 |
| 2005/0163574 | A1 | | 7/2005 | Hilfiker | |
| 2005/0260042 | A1 | * | 11/2005 | Kang | 405/302.7 |
| 2005/0271478 | A1 | * | 12/2005 | Ferraiolo | 405/284 |
| 2005/0286981 | A1 | * | 12/2005 | Robertson et al. | 405/284 |
| 2006/0204342 | A1 | | 9/2006 | Hilfiker | |
| 2006/0204343 | A1 | * | 9/2006 | Kallen | 405/284 |
| 2006/0239783 | A1 | * | 10/2006 | Kallen | 405/284 |
| 2007/0014638 | A1 | | 1/2007 | Brown | |
| 2008/0308780 | A1 | * | 12/2008 | Sloan et al. | 256/31 |
| 2008/0315169 | A1 | * | 12/2008 | McNeill | 256/1 |
| 2009/0016825 | A1 | * | 1/2009 | Taylor | 405/284 |
| 2009/0067933 | A1 | | 3/2009 | Taylor | |
| 2009/0123238 | A1 | * | 5/2009 | Morizot et al. | 405/302.4 |
| 2009/0285639 | A1 | * | 11/2009 | Taylor et al. | 405/262 |
| 2009/0304456 | A1 | | 12/2009 | Taylor | |
| 2010/0247248 | A1 | | 9/2010 | Taylor | |
| 2010/0254770 | A1 | * | 10/2010 | Morizot et al. | 405/302.4 |
| 2011/0170957 | A1 | | 7/2011 | Taylor | |
| 2011/0170958 | A1 | * | 7/2011 | Taylor | 405/262 |
| 2011/0170960 | A1 | | 7/2011 | Taylor | |
| 2011/0229274 | A1 | | 9/2011 | Taylor | |
| 2011/0311317 | A1 | | 12/2011 | Taylor | |
| 2011/0311318 | A1 | | 12/2011 | Taylor | |

FOREIGN PATENT DOCUMENTS

| | | |
|---|---|---|
| FR | 530097 | 9/1921 |
| FR | 1006087 | 1/1952 |
| JP | 3114014 | 6/1991 |
| JP | 08209703 | 8/1996 |
| JP | 08326074 | 12/1996 |

(56) References Cited

FOREIGN PATENT DOCUMENTS

| | | |
|---|---|---|
| KR | 1020080058697 | 6/2008 |
| KR | 1020100027693 | 3/2010 |
| WO | WO9413890 | 6/1994 |
| WO | WO2009009369 | 1/2009 |
| WO | WO2009140576 | 11/2009 |
| WO | WO2010082940 | 7/2010 |
| WO | WO2011084983 | 7/2011 |
| WO | WO2011084986 | 7/2011 |
| WO | WO2011084989 | 7/2011 |
| WO | WO2011127349 | 10/2011 |
| WO | WO2011059807 | 12/2011 |
| WO | WO2011159808 | 12/2011 |

OTHER PUBLICATIONS

International Application No. PCT/US09/031494—International Search Report and Written Opinion dated Mar. 13, 2009.
International Application No. PCT/US09/44099—International Search Report and Written Opinion dated Aug. 12, 2009.
International Application No. PCT/US08/069011—International Preliminary Report on Patentability dated Jan. 21, 2010.
International Application No. PCT/US10/036991—International Search Report and Written Opinion dated Aug. 2, 2010.
International Application No. PCT/US09/44099—International Preliminary Report on Patentability dated Nov. 25, 2010.
International Application No. PCT/US2010/036991—International Preliminary Examination Reported mailed Jul. 14, 2011.
International Application No. PCT/US09/0031494—International Preliminary Report on Patentability dated Jul. 19, 2011.
International Application No. PCT/US2010/036991—Corrected International Preliminary Examination Report mailed Aug. 15, 2011.
International Application No. PCT/US2011/031688—International Search Report and Written Opinion dated Nov. 30, 2011.
International Application No. PCT/US2011/040540—International Search Report and Written Opinion dated Feb. 17, 2012.
International Application No. PCT/US2011/040543—International Search Report and Written Opinion dated Feb. 21, 2012.
International Application No. PCT/US2011/040541—International Search Report and Written Opinion dated Feb. 27, 2012.
Webster's tenth edition, "Collegiate Dictionary", p. 423; 1998.

* cited by examiner

MECHANICALLY STABILIZED EARTH WELDED WIRE FACING CONNECTION SYSTEM AND METHOD

CROSS-REFERENCE TO RELATED APPLICATION

The present application is a continuation-in-part of co-pending U.S. patent application Ser. No. 12/818,011, entitled "Mechanically Stabilized Earth System and Method," which was filed on Jun. 17, 2010, the contents of which are incorporated herein by reference in its entirety.

BACKGROUND OF THE DISCLOSURE

Retaining wall structures that use horizontally positioned soil inclusions to reinforce an earth mass in combination with a facing element are referred to as mechanically stabilized earth (MSE) structures. MSE structures can be used for various applications including retaining walls, bridge abutments, dams, seawalls, and dikes.

The basic MSE implementation is a repetitive process where layers of backfill and horizontally-placed soil reinforcing elements are positioned one atop the other until a desired height of the earthen structure is achieved. Typically, grid-like steel mats or welded wire mesh are used as soil reinforcing elements. In most applications, the soil reinforcing elements consist of parallel, transversely-extending wires welded to parallel, longitudinally-extending wires, thus forming a grid-like mat or structure. Backfill material and the soil reinforcing mats are combined and compacted in series to form a solid earthen structure, taking the form of a standing earthen wall.

In some instances, the soil reinforcing elements can be attached or otherwise coupled to a substantially vertical wall either forming part of the MSE structure or offset a short distance therefrom. The vertical wall is typically made either of concrete or a steel wire facing and not only serves to provide tensile resistance to the soil reinforcing elements but also prevents erosion of the MSE. The soil reinforcing elements extending from the compacted backfill may be attached directly to a vertical wall of the facing in a variety of configurations.

Although there are several methods of attaching soil reinforcing elements to facing structures, it nonetheless remains desirable to find improved attachment methods and systems that provide greater resistance to shear forces inherent in such structures.

SUMMARY OF THE DISCLOSURE

Embodiments of the disclosure may provide a system for constructing a mechanically stabilized earth structure. The system may include a wire facing having a bend formed therein to form a horizontal element and a vertical facing, the horizontal element having initial and terminal wires each coupled to a plurality of horizontal wires, and the vertical facing having a plurality of vertical wires coupled to a plurality of facing cross wires and a top-most cross wire. The system may further include a soil reinforcing element having a plurality of transverse wires coupled to at least two longitudinal wires having lead ends that converge, and a connector having a coil coupled to the lead ends of the longitudinal wires and a threaded rod configured to extend through both the vertical facing and the coil, wherein a washer engages the vertical facing and prevents the threaded rod from passing completely therethrough and a first nut is threaded onto the threaded rod to prevent its removal from the coil.

Another exemplary embodiment of the disclosure may provide a method of constructing a mechanically stabilized earth structure. The method may include providing a first lift comprising a first wire facing being bent to form a first horizontal element and a first vertical facing, the first horizontal element having initial and terminal wires coupled to a plurality of horizontal wires, and the first vertical facing having a plurality of vertical wires coupled to a plurality of facing cross wires including a last facing cross wire and a top-most cross wire. The method may further include extending a first threaded rod through the first vertical facing and a first coil coupled to converging lead ends of longitudinal wires of a first soil reinforcing element, and engaging the vertical facing with a first washer disposed radially about the first threaded rod, the first washer being configured to prevent the first threaded rod from passing completely through the first vertical facing. The method may further include securing the first threaded rod to the first coil with a first nut, placing a screen on the first wire facing whereby the screen covers at least a portion of the first vertical facing and first horizontal element, and placing backfill on the first lift to a first height Y above the last facing cross wire of the first vertical facing.

Another exemplary embodiment of the disclosure may provide another system for constructing a mechanically stabilized earth structure. The system may include first and second lifts. The first lift may include a first wire facing having a first horizontal element and a first vertical facing, the first horizontal element having initial and terminal wires coupled to a plurality of horizontal wires, and the first vertical facing having a plurality of vertical wires coupled to a plurality of facing cross wires including a last facing cross wire and a top-most cross wire. The first lift may further include a first soil reinforcing element coupled to the first wire facing, the first soil reinforcing element having converging lead ends coupled to a first coil, and a first threaded rod extended through the first vertical facing and the first coil, wherein a first washer disposed radially about the first threaded rod engages the first vertical facing and prevents the first threaded rod from passing completely therethrough and a first nut is threaded onto the first threaded rod to prevent its removal from the first coil. The first lift may further include backfill disposed on the first wire facing to a first height above the last facing cross wire of the first vertical facing. The second lift may be disposed on the backfill of the first lift and may include a second wire facing having a second horizontal element and a second vertical facing, a second soil reinforcing element coupled to the second wire facing, the second soil reinforcing element having converging lead ends coupled to a second coil, and a second threaded rod extended through the first and second vertical facings and the second coil, wherein a second washer disposed radially about the second threaded rod engages the first vertical facing and prevents the second threaded rod from passing therethrough and a second nut is threaded onto the second threaded rod to prevent its removal from the coil.

DETAILED DESCRIPTION

Figure 1:
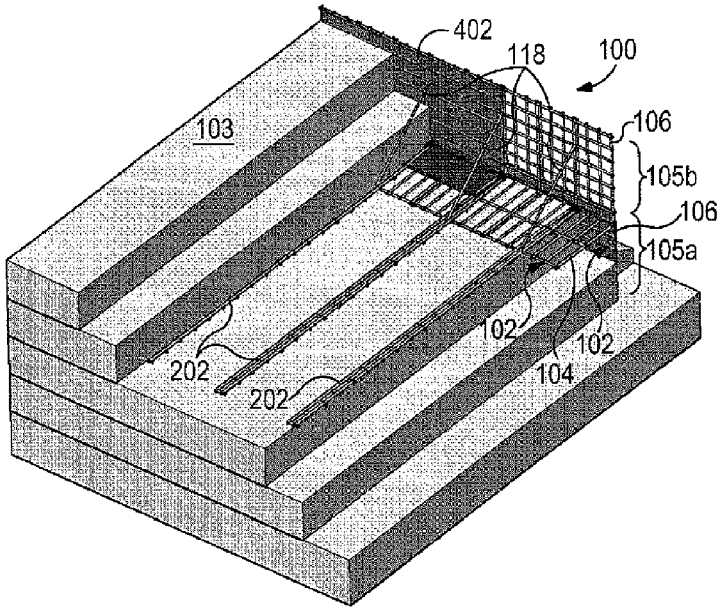
FIG. 1 is an isometric view of an exemplary system of constructing a mechanically stabilized earth structure, according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring to FIG. 1, illustrated is an isometric view of an exemplary system 100 for erecting an MSE structure. In brief, and as will be described in more detail below, the system 100 may include one or more wire facings 102 stacked one atop the other and having one or more soil reinforcing elements 202 coupled thereto. One or more struts 118 may also be coupled to each wire facing 102 and adapted to maintain each wire facing 102 in a predetermined angular configuration. Backfill 103 may be sequentially added to the system 100 in a plurality of layers configured to cover the soil reinforcing elements 202, thereby providing tensile strength to the wire facings 102 and preventing the wire facings 102 from bulging outward. A more detailed discussion of these and other elements of the system 100 now follows.

Figure 2A:
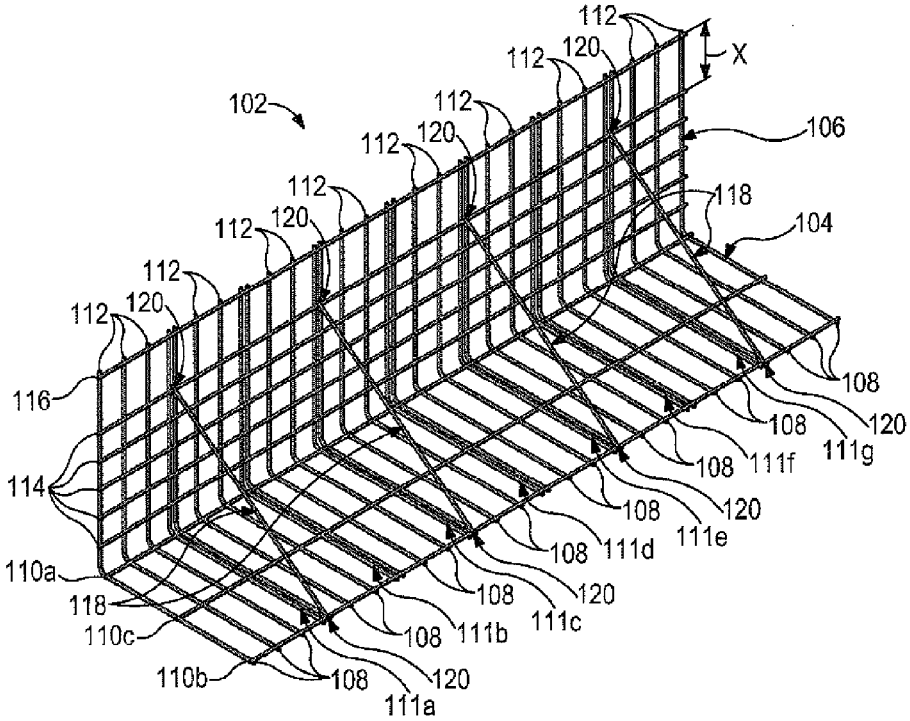
FIG. 2A is an isometric view of an exemplary wire facing element, according to one or more aspects of the present disclosure.
Figure 2B:
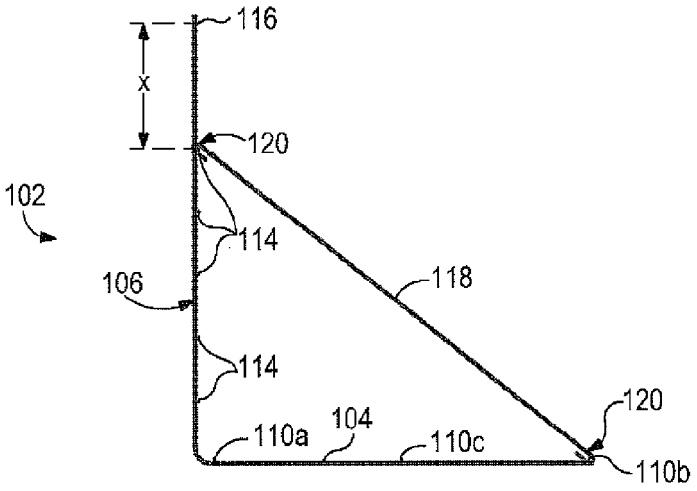
FIG. 2B is a side view of the wire facing element shown in FIG. 2A.

Referring to FIGS. 2A and 2B, each wire facing 102 of the system 100 may be fabricated from several lengths of cold-drawn wire welded and arranged into a mesh panel. The wire mesh panel can then be folded or otherwise shaped to form a substantially L-shaped assembly including a horizontal element 104 and a vertical facing 106. The horizontal element 104 may include a plurality of horizontal wires 108 welded or otherwise attached to one or more cross wires 110, such as an initial wire 110*a*, a terminal wire 110*b*, and a median wire 110*c*. The initial wire 110*a* may be disposed adjacent to and directly behind the vertical facing 106, thereby being positioned inside the MSE structure. The terminal wire 110*b* may be disposed at or near the distal ends of the horizontal wires 108. The median wire 110*c* may be welded or otherwise coupled to the horizontal wires 108 and disposed laterally between the initial and terminal wires 110*a,b*. As can be appreciated, any number of cross wires 110 can be employed without departing from the scope of the disclosure. For instance, in at least one embodiment, the median wire 110*c* may be excluded from the system 100.

The vertical facing 106 can include a plurality of vertical wires 112 extending vertically with reference to the horizontal element 104 and laterally-spaced from each other. In one embodiment, the vertical wires 112 may be vertically-extending extensions of the horizontal wires 108. The vertical facing 106 may also include a plurality of facing cross wires 114 vertically-offset from each other and welded or otherwise attached to the vertical wires 112. A top-most cross wire 116 may be vertically-offset from the last facing cross wire 114 and also attached to the vertical wires 112 in like manner.

In at least one embodiment, each vertical wire 112 may be separated by a distance of about 4 inches on center from adjacent vertical wires 112, and the facing cross wires 114 may also be separated from each other by a distance of about 4 inches on center, thereby generating a grid-like facing composed of a plurality of square voids having about a 4"×4" dimension. As can be appreciated, however, the spacing between adjacent wires 112, 114 can be varied to more or less than 4 inches to suit varying applications and the spacing need not be equidistant. In one embodiment, the top-most cross wire 116 may be vertically-offset from the last facing cross wire 114 by a distance X, as will be discussed in more detail below.

The wire facing 102 may further include a plurality of connector leads 111*a-g* extending from the horizontal element 104 and up the vertical facing 106. In an embodiment, each connector lead 111*a-g* may include a pair of horizontal wires 108 (or vertical wires 112, if taken from the frame of reference of the vertical facing 106) laterally-offset from each other by a short distance. The short distance can vary depending on the particular application, but may generally include about a one inch separation. In one embodiment, each connector lead 111*a-g* may be equidistantly-spaced from each other along the horizontal element 104 and/or vertical facing 106, and configured to provide a visual indicator to an installer as to where a soil reinforcing element 202 (FIGS. 1 and 3) may be properly attached, as will be described in greater detail below. In at least one embodiment, each connector lead 111*a-g* may be spaced from each other by about 12 inches on center. As can be appreciated, however, such relative distances may vary to suit particular applications.

In one or more embodiments, the cross wires 110*a-c* of the horizontal element 104 may be larger in diameter than the cross wires 114 and top-most cross wire 116 of the vertical facing 106. In at least one embodiment, the cross wires 110*a-c* of the horizontal element 104 may have diameters at least twice as large as the facing cross wires 114 and top-most cross wire 116 of the vertical facing 106. In other embodiments, however, the diameter of wires 110*a-c*, 114, 116 may be substantially the same or the facing cross wires 114 may be larger than the cross wires 110*a-c* of the horizontal element 104 without departing from the scope of the disclosure.

Still referring to FIGS. 2A-2B, one or more struts 118 may be operatively coupled to the wire facing 102. As illustrated, the struts 118 may be coupled to both the vertical facing 106 and the horizontal element 104 at appropriate locations. Each strut 118 may be prefabricated with or include a connection device 120 disposed at each end of the strut 118 and configured to fasten or otherwise attach the struts 118 to both the horizontal element 104 and the vertical facing 106. In at least one embodiment, and as can best be seen in FIG. 5, the connection device 120 may include a hook that is bent about 180° back upon itself. In other embodiments, the connection device 120 may include a wire loop disposed at each end of the struts 118 that can be manipulated, clipped, or otherwise tied to both the horizontal element 104 and the vertical facing 106. As can be appreciated, however, the struts 118 can be coupled to the horizontal element 104 and the vertical facing 106 by any practicable method or device known in the art.

Each strut 118 may be coupled at one end to at least one facing cross wire 114 and at the other end to the terminal wire 110*b*. In other embodiments, one or more struts 118 may be coupled to the median wire 110*c* instead of the terminal wire 110*b*, without departing from the scope of the disclosure. As illustrated, each strut 118 may be coupled to the wire facing 102 in general alignment with a corresponding connector lead 111*a-g*. In other embodiments, however, the struts 118 can be connected at any location along the respective axial lengths of any facing cross wire 114 and terminal wire 110*b*, without departing from the scope of the disclosure. In yet other embodiments, the struts 118 may be coupled to a vertical wire 112 of the vertical facing 106 and/or a horizontal wire 108 of the horizontal element 104, respectively, without departing from the scope of the disclosure.

The struts 118 are generally coupled to the wire facing 102 before any backfill 103 (FIG. 1) is added to the respective layer of the system 100. During the placement of backfill 103, and during the life of the system 100, the struts 118 may be adapted to prevent the vertical facing 106 from bending past a predetermined vertical angle. For example, in the illustrated embodiment, the struts 118 may be configured to maintain the vertical facing 106 at or near about 90° with respect to the horizontal element 104. As can be appreciated, however, the struts 118 can be fabricated to varying lengths or otherwise attached at varying locations along the wire facing 102 to maintain the vertical facing 106 at a variety of angles of orientation. The struts 118 may allow installers to walk on the backfill 103 of the MSE structure, tamp it, and compact it fully before adding a new lift or layer, as will be described below.

Figure 3:
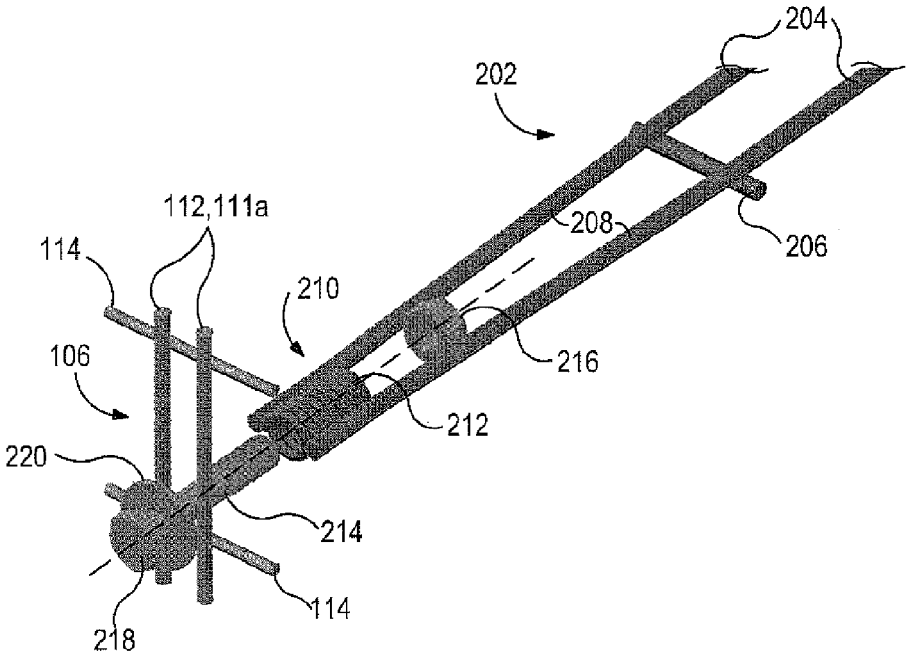
FIG. 3 is an isometric view of a soil reinforcing element used in the system shown in FIG. 1, according to one or more aspects of the present disclosure.

Referring now to FIG. 3, illustrated is an exemplary soil reinforcing element 202 that may be attached or otherwise coupled to a portion of the wire facing 102 (FIGS. 2A and 2B) in the construction of an MSE structure. The soil reinforcing element 202 may include a welded wire grid having a pair of longitudinal wires 204 that extend substantially parallel to each other. In other embodiments, there could be more than two longitudinal wires 204 without departing from the scope of the disclosure. The longitudinal wires 204 may be joined to one or more transverse wires 206 in a generally perpendicular fashion by welds at their intersections, thus forming a welded wire gridworks. In one or more embodiments, the spacing between each longitudinal wire 106 may be about 2 inches, while the spacing between each transverse wire 206 (see also FIG. 4) may be about 6 inches. As can be appreciated, however, the spacing and configuration of adjacent respective wires 204, 206 may vary for a variety of reasons, such as the combination of tensile force requirements that the soil reinforcing element 202 must endure and resist. In other embodiments, the soil reinforcing element 202 may include more or less than two longitudinal wires 106 without departing from the scope of the disclosure.

In one or more embodiments, lead ends 208 of the longitudinal wires 204 may generally converge and be welded or otherwise attached to a connector 210. In at least one embodiment, the connector 210 (shown in an exploded view for ease of viewing) may include a coil 212, a threaded rod 214, such as a bolt or a length of rebar, and a nut 216. As illustrated, the coil 212 may include a plurality of indentations or grooves defined along its axial length which provide a more suitable welding surface for attaching the lead ends 208 of the longitudinal wires 204 thereto. As can be appreciated, such indentations and/or grooves can result in a stronger resistance weld. In one embodiment, the coil 212 can be a compressed coil spring. In other embodiments, the coil 212 can be another nut or a coil rod that is welded to the longitudinal wires 204. Other exemplary embodiments of the connector 210 contemplated herein are described in co-owned U.S. Pat. No. 6,571,293, entitled "Anchor Grid Connector Element," issued on Feb. 11, 2003 and hereby incorporated by reference to the extent not inconsistent with the present disclosure.

To secure the soil reinforcing element 202 to a portion of the wire facing 102 (FIG. 2B), or more particularly the vertical facing 106, the head 218 of the threaded rod 214 may be disposed on the front side of at least two vertical wires 112, such as at a connector lead 111*a*. The body of the threaded rod 214 can be extended through the vertical facing 106 and coil 212 and secured thereto with the nut 216 at its end. As illustrated, the head 218 may be prevented from passing through the vertical wires 112 or connector lead 111*a* by employing a washer 220 disposed radially about the threaded rod and adapted to provide a biasing engagement with the vertical wires 112 or connector lead 111*a*. As the nut 216 is tightened, it brings the coil 212 into engagement, or at least adjacent to, the back side of the vertical facing 106.

In embodiments where the lateral spacing of adjacent vertical wires 112 is such that the connector 210 and a portion of the soil reinforcing element 202 may be able to extend through the vertical facing 106, it is further contemplated to employ secondary washers or bearing plates (not shown) on the inside or back side of the vertical facing 106. For instance, at least one secondary washer or bearing plate may extend radially around the threaded rod and be disposed axially adjacent the coil 212 and large enough so as to bear on at least two vertical wires 112 and prevent the connector 210 from passing through the vertical facing 106. Accordingly, the soil reinforcing element 202 may be secured against removal from the wire facing 102 on both front and back sides of the vertical facing 106.

Figure 4:
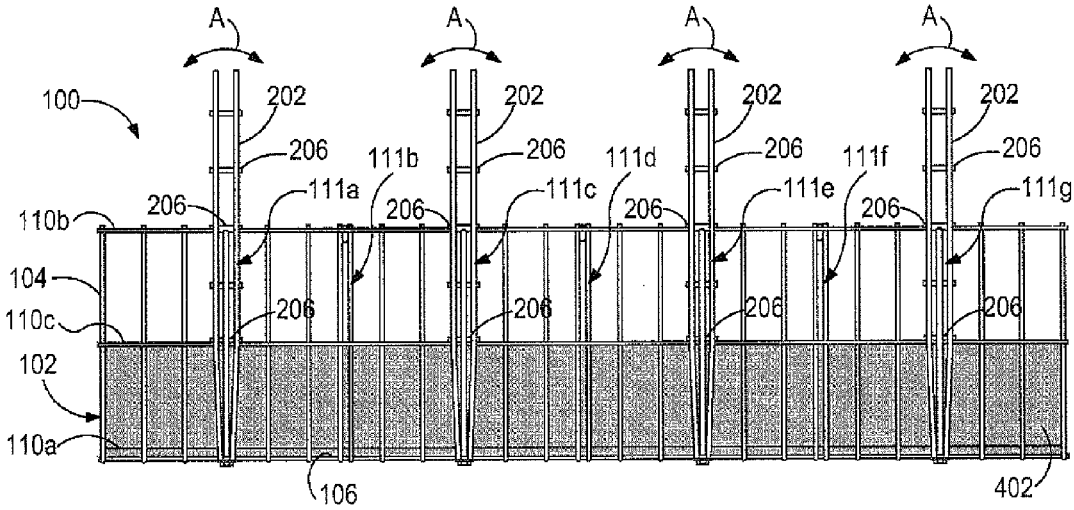
FIG. 4 is a plan view of the system of constructing a mechanically stabilized earth structure, according to one or more aspects of the present disclosure.

Referring to FIG. 4, depicted is a plan view of the system 100 where at least four soil reinforcing elements 202 have been coupled to a wire facing 102. As illustrated, the soil reinforcing elements 202 may be attached to the wire facing 102 at one or more connector leads 111*a-g* of the horizontal element 104. In one or more embodiments, soil reinforcing elements 202 may be connected to each connector lead 111*a-g*, every other connector lead 111*a-g*, every third connector lead 111*a-g*, etc. For instance, FIG. 4 depicts soil reinforcing elements 202 connected to every other connector lead 111*a*, 111*c*, 111*e*, and 111*g*.

In one or more embodiments, the terminal wire 110*b* and/or median wire 110*c* may be located at a predetermined distance from the initial wire 110*a* to allow at least one transverse wire 206 of the soil reinforcing element 202 to be positioned adjacent the terminal and/or median wires 110*b*, 110*c* when the soil reinforcing element 202 is tightened against wire facing 102 with the connector 210. Accordingly, corresponding transverse wires 206 may be coupled or otherwise attached to the terminal and/or median wires 110*b*, 110*c*. In at least one embodiment, the transverse wires 206 may be positioned directly behind the terminal and/or median wires 110*b*, 110*c* and secured thereto using a coupling device (not shown), such as a hog ring, wire tie, or the like. In other embodiments, however, the transverse wires 206 may be positioned in front of the terminal and/or median wires 110*b*, 110*c* and similarly secured thereto with a coupling device, without departing from the scope of the disclosure. In yet other embodiments, the soil reinforcing element 202 is secured to only one or none of the terminal and/or median wires 110*b*, 110*c*.

In embodiments where the soil reinforcing element 202 is not coupled to the terminal or median wires 110*b*, 110*c*, it may be free to swivel or otherwise rotate in a horizontal plane as generally indicated by arrows A. As can be appreciated, this configuration allows the soil reinforcing elements 202 to swivel in order to avoid vertically-disposed obstructions, such as drainage pipes, catch basins, bridge piles, or bridge piers, which may be encountered in the backfill 103 (FIG. 1) field.

As shown in both FIGS. 1 and 4, the system 100 may further include a screen 402 disposed on the wire facing 102 once the soil reinforcing elements 202 have been connected as generally described above. In one embodiment, the screen 402 can be disposed on portions of both the vertical facing 106 and the horizontal element 104. As illustrated, the screen 402 may be placed on substantially all of the vertical facing 106 and only a portion of the horizontal element 104. In other embodiments, however, the screen 402 may be placed in different configurations, such as covering the entire horizontal element 104 or only a portion of the vertical facing 106. In operation, the screen 402 may be configured to prevent backfill 103 (FIG. 1) from leaking, eroding, or otherwise raveling out of the wire facing 102. In one embodiment, the screen 402 may be a layer of filter fabric. In other embodiments, however, the screen 402 may include construction hardware cloth or a fine wire mesh. In yet other embodiments, the screen 402 may include a layer of cobble, such as large rocks that will not advance through the square voids defined in the vertical facing 106, but which are small enough to prevent backfill 103 materials from penetrating the wire facing 102.

Referring again to FIG. 1, the system 100 can be characterized as a lift 105 configured to build an MSE structure wall to a particular required height. As illustrated in FIG. 1, a plurality of lifts 105*a*, 105*b* may be required to reach the required height. Each lift 105*a*, 105*b* may include the elements of the system 100 as generally described above in FIGS. 2A, 2B, 3, and 4. While only two lifts 105*a*, 105*b* are shown in FIG. 1, it will be appreciated that any number of lifts may be used to fit a particular application and reach a desired height for the MSE structure. As depicted, the first lift 105*a* may be disposed generally below the second lift 105*b* and the horizontal elements 104 of each lift 105*a*, 105*b* may be oriented substantially parallel to and vertically-offset from each other. The angle of orientation for the vertical facings 106 of each lift 105*a*, 105*b* may be similar or may vary, depending on the application. For example, the vertical facings 106 of each lift 105*a*, 105*b* may be disposed at angles less than or greater than 90° with respect to horizontal.

In at least one embodiment, the vertical facings 106 of each lift 105*a*, 105*b* may be substantially parallel and continuous, thereby constituting an unbroken vertical ascent for the facing of the MSE structure. In other embodiments, however, the vertical facings 106 of each lift 105*a*, 105*b* may be laterally offset from each other. For example, the disclosure contemplates embodiments where the vertical facing 106 of the second lift 105*b* may be disposed behind or in front of the vertical facing 106 of the first lift 105*a*, and so on until the desired height of the MSE wall is realized.

In one or more embodiments, because of the added strength derived from the struts 118, each lift 105*a*, 105*b* may be free from contact with any adjacent lift 105*a*, 105*b*. Thus, in at least one embodiment, the first lift 105*a* may have backfill placed thereon up to or near the vertical height of the vertical facing 106 and compacted so that the second lift 105*b* may be placed completely on the compacted backfill of the first lift 105*a* therebelow. Whereas conventional systems would require the vertical facing 106 of the first lift 105*a* to be tied into the vertical facing 106 of the second lift 105*b* to prevent its outward displacement, the present disclosure allows each lift 105*a*, 105*b* to be physically free from engagement with each other. This may prove advantageous during settling of the MSE structure. For instance, where adjacent lifts 105*a*, 105*b* are not in contact with each other, the system 100 may settle without causing adjacent lifts to bind on each other, which can potentially diminish the structural integrity of the MSE structure.

Figure 5:
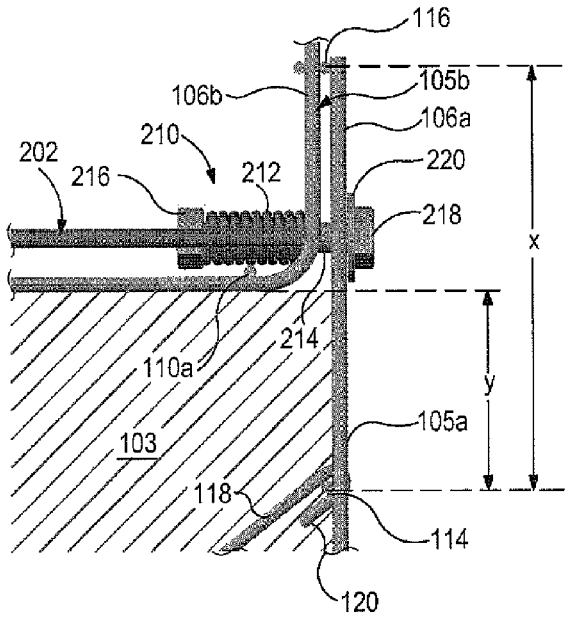
FIG. 5 is a side view of the connection apparatus for connecting at least two lifts or systems, according to one or more aspects of the present disclosure.

Referring now to FIG. 5, other embodiments of the disclosure include coupling or otherwise engaging the first and second lifts 105*a,b* in sliding engagement with one another using the connector 210 of the soil reinforcing elements 202. As shown in FIG. 5, each lift 105*a*, 105*b* may have a corresponding vertical facing 106*a*, 106*b*. The first lift 105*a* may be disposed substantially below the second lift 105*b*, with its vertical facing 106*a* being placed laterally in front of the vertical facing 106*b* of the second lift 105*b*. Backfill 103 may be added to at least a portion of the first lift 105*a* to a first height or distance Y above the last facing cross wire 114. The second lift 105*b* may be disposed on top of the backfill 103, thereby being placed a distance Y above the last facing cross wire 114. As will be appreciated, the first height or distance Y can be any distance or height less than the distance X. For example, the distance Y can be about but less than the distance X, thereby having the backfill 103 level up to but just below the top-most cross wire 116 of the vertical facing 106*a*.

In order to bring the vertical facings 106*a,b* of each lift 105*a,b* into engagement or at least adjacent one another, the threaded rod 214 of the connector 210 may be configured to extend through each vertical facing 106*a,b* and be secured with the nut 216. In order to ensure a sliding engagement between the first and second lifts 105*a,b*, the nut 216 may be "finger-tightened," or tightened so as to nonetheless allow vertical movement of either the first or second lift 105*a,b* with respect to each other. Tightening the nut 216 may bring the coil 212 into engagement with the vertical facing 106*b* of the second lift 105*b*, having the coil rest on the initial wire 110*a*, and also bring the washer 220 into engagement with the vertical facing 106*a* of the first lift 105*a*. In at least one embodiment, tightening the nut 216 may also being the top-most cross wire 116 into engagement with the vertical facing 106*b* and thereby further preventing the outward displacement of the vertical facing 106*a*. However, in other embodiments, the top-most cross wire 116 is not necessarily brought into contact with the vertical facing 106*b*, but the vertical facing 106*b* may be held in its angular configuration by the strut 118 and connection device 120 disposed on the upper facing cross wire 114.

Placing the second lift 105*b* a distance Y above the upper facing cross wire 114 allows the second lift 105*b* to vertically shift the distance Y in reaction to MSE settling or thermal expansion/contraction of the MSE structure. Accordingly, the distance Y can be characterized as a distance of settlement over which the second lift 105*b* may be able to traverse without binding on the first lift 105*a* and thereby weakening the structural integrity of the MSE system.

Figure 6A:
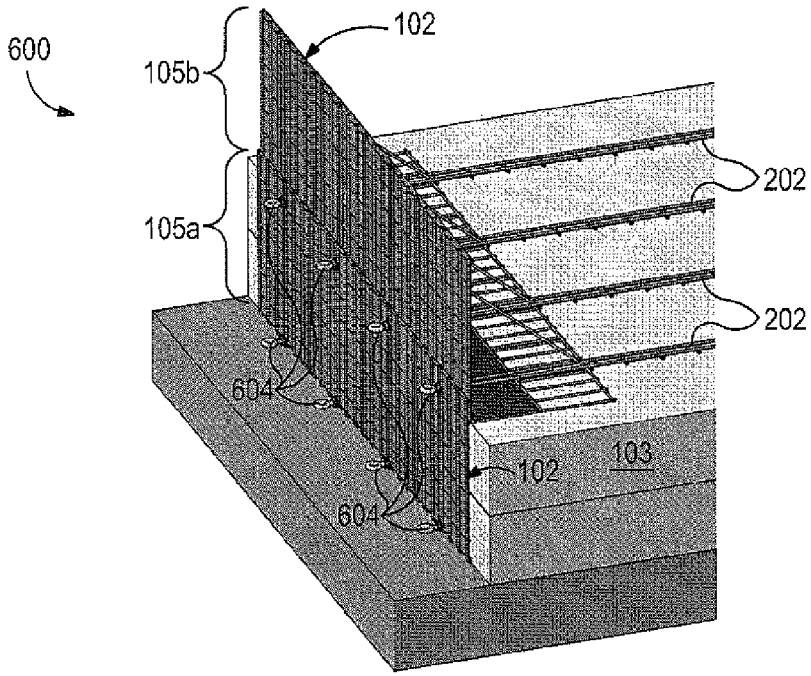
FIG. 6A is an isometric view of another system of constructing a mechanically stabilized earth structure, according to one or more aspects of the present disclosure.
Figure 6B:
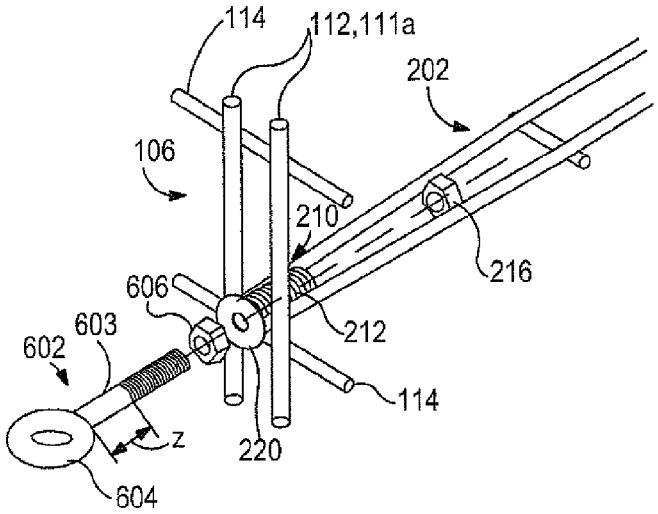
FIG. 6B is a side view of a soil reinforcing element used in the system shown in FIG. 6A, according to one or more aspects of the present disclosure.

Referring now to FIGS. 6A-6B, depicted is another exemplary embodiment of the system 100 depicted in FIG. 1, embodied and described here as system 600. As such, FIGS. 6A-6B may best be understood with reference to FIGS. 1-5, wherein like numerals correspond to like elements and therefore will not be described again in detail. Similar to the system 100 generally described above, system 600 may include one or more lifts 105*a,b* stacked one atop the other and having one or more soil reinforcing elements 202 coupled the wire facings 102. The soil reinforcing elements 202 may extend into the backfill 103, and the backfill 103 may sequentially be added to the system 600 in a plurality of layers configured to cover the soil reinforcing elements 202 and provide tensile strength to each wire facing 102.

The soil reinforcing elements 202 in system 600, however, may include a different type of connector 210 than described in system 100. For example, any type of threaded rod can be extended through the coil 212 and secured thereto with a nut 216, thereby replacing the threaded rod 214 as generally described with reference to FIG. 3. Referring to the exploded view of the connector 210 in FIG. 6B, a threaded eye-bolt 602 with a head 604 may be employed. As illustrated, the head 604 may be a loop. To secure the soil reinforcing element 202 to a portion of a wire facing 102, or in particular the vertical facing 106, the head 604 of the eye-bolt 602 may be disposed on the front side of at least two vertical wires 112, such as at a connector lead 111*a*, such that the body of the eye-bolt 602 can be extended through the coil 212 and secured thereto with the nut 216. As illustrated, the loop or head 604 may be prevented from passing through the vertical wires 112 or connector lead 111*a* by employing a washer 220 adapted to provide a biasing engagement with the vertical wires 112 or connector lead 111*a*. As the nut 216 is tightened, it brings the coil 212 into engagement or at least adjacent to the back side of the vertical facing 106, and the washer 220 into engagement with the vertical wires 112 or connector lead 111*a*.

In one or more embodiments, the body of the eye-bolt 602 may also be threaded through a second nut 606 adapted to be disposed against the washer 220 on the outside of the vertical facing 106. As illustrated, the body of the eye-bolt 602 can have a non-threaded portion 603 configured to offset the second nut 606 from the head 604 a distance Z when the second nut 606 is fully threaded onto the body. This may allow the head 604 to be laterally-offset from the vertical facing 106, as shown in FIG. 6A.

As can be appreciated, having the head 604 offset from the vertical facing 106 may provide a location to attach or otherwise form a facing (not shown) to the system 600. For example, rebar may be passed through or otherwise coupled to the heads 604 of each connector 210, thereby providing a skeletal rebar structure prepared to be formed within a facing structure, such as being cast within a concrete skin. Moreover, lengths of rebar may be used to attach turnbuckles or other connection devices configured to couple the vertical facing 106 to a laterally-adjacent facing. As illustrated, the loop or head 604 may be horizontally-disposed, but may also be vertically-disposed without departing from the scope of the disclosure. Consequently, rebar may be passed either vertically or horizontally through adjacent loops or heads 604 in various embodiments of the system 600. Exemplary connective systems that may be used in conjunction with the present disclosure can be found in co-pending U.S. patent application Ser. No. 12/132,750, entitled "Two Stage Mechanically Stabilized Earth Wall System," filed on Jun. 4, 2008 and hereby incorporated by reference to the extent not inconsistent with the present disclosure.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired earth retaining structures. Therefore, the claims should be interpreted in a broad manner, consistent with the present disclosure.

We claim:

1. A mechanically stabilized earth structure, comprising:

a wire facing having a bend formed therein to form a horizontal element and a vertical facing, the horizontal element having initial and terminal wires each coupled to a plurality of horizontal wires, and the vertical facing comprising:

a plurality of vertical wires coupled to a plurality of facing cross wires and a top-most cross wire; and a plurality of connector leads extending from the horizontal element and up the vertical facing, each connector lead comprising two vertical wires of the plurality of vertical wires, the two vertical wires being laterally offset from each other by a short distance;

a soil reinforcing element having a plurality of transverse wires coupled to at least two longitudinal wires having lead ends that converge; and a connector having a coil coupled to the lead ends of the longitudinal wires and a threaded rod configured to extend through both the vertical facing and the coil, wherein a washer engages the vertical facing and prevents the threaded rod from passing completely therethrough and a first nut is threaded onto the threaded rod to prevent its removal from the coil and to detachably couple the soil reinforcing element to the vertical facing between the two vertical wires of a connector lead of the plurality of connector leads such that at least a portion of the soil reinforcing element extends beyond an end portion of the horizontal element.

2. The structure of claim 1, wherein the threaded rod is a bolt.

3. The structure of claim 1, wherein the threaded rod is an eye-bolt having a non-threaded portion extending a pre-determined distance from a head.

4. The structure of claim 3, wherein the connector further comprises a second nut threaded onto the eye-bolt up to the non-threaded portion and configured to laterally-offset the head of the eye-bolt the pre-determined distance from the vertical facing.

5. The structure of claim 4, wherein the head is a loop configured to receive a length of rebar configured to form part of a facing structure.

6. The structure of claim 1, further comprising a strut having a first end coupled to the vertical facing and a second end coupled to the horizontal element, the strut being configured to maintain the vertical facing at a predetermined angle with respect to the horizontal element.

7. The structure of claim 6, wherein the first end of the strut is coupled to one of the plurality of facing cross wires disposed below the top-most cross wire and the second end of the strut is coupled to the terminal wire.

8. A method of constructing a mechanically stabilized earth structure, comprising:

providing a first lift comprising a first wire facing being bent to form a first horizontal element and a first vertical facing, the first horizontal element having initial and terminal wires coupled to a plurality of horizontal wires, and the first vertical facing comprising:

a plurality of first vertical wires coupled to a plurality of facing cross wires including a last facing cross wire and a top-most cross wire; and a plurality of first connector leads extending from the first horizontal element and up the first vertical facing, each first connector lead comprising two vertical wires of the plurality of first vertical wires, the two vertical wires of the plurality of first vertical wires being laterally offset from each other by a short distance;

extending a first threaded rod between the two vertical wires of a first connector lead of the plurality of first connector leads and through the first vertical facing and a first coil coupled to converging lead ends of longitudinal wires of a first soil reinforcing element;

engaging the first vertical facing with a first washer disposed radially about the first threaded rod, the first washer being configured to prevent the first threaded rod from passing completely through the first vertical facing;

detachably coupling the first threaded rod to the first coil with a first nut, such that at least a portion of the first soil reinforcing element extends beyond an end portion of the first horizontal element;

placing a screen on the first wire facing whereby the screen covers at least a portion of the first vertical facing and first horizontal element; and placing backfill on the first lift to a first height above the last facing cross wire of the first vertical facing, wherein the first height is below the top-most cross wire.

9. The method of claim 8, further comprising coupling a first end of a strut to the first vertical facing and a second end of the strut to the first horizontal element, the strut being configured to maintain the first vertical facing at a predetermined angle with respect to the first horizontal element.

10. The method of claim 9, wherein the first end of the strut is coupled to the last facing cross wire and the second end of the strut is coupled to the terminal wire.

11. The method of claim 10, further comprising placing a second lift on the backfill of the first lift, the second lift comprising a second wire facing being bent to form a second horizontal element and a second vertical facing, the second vertical facing comprising:

a plurality of second vertical wires and a plurality of second connector leads extending from the second horizontal element and up the second vertical facing, each second connector lead comprising two vertical wires of the plurality of second vertical wires, the two vertical wires of the plurality of second vertical wires being laterally offset from each other by a short distance.

12. The method of claim 11, wherein the second lift is not in contact with the first lift but is completely supported by the backfill of the first lift.

13. The method of claim 11, further comprising:

extending a second threaded rod between the two vertical wires of a second connector lead of the plurality of second connector leads and the two wires of the first connector lead and through the first and second vertical facings and a second coil coupled to converging lead ends of longitudinal wires of a second soil reinforcing element;

engaging the first vertical facing with a second washer disposed radially about the second threaded rod to prevent the second threaded rod from passing completely through both the first and second vertical facings; and detachably coupling the second threaded rod to the second coil with a second nut to allow the second lift to slidingly engage the first lift for at least the first height, wherein at least a portion of the second soil reinforcing element extends beyond an end portion of the second horizontal element.

14. A mechanically stabilized earth structure, comprising:

a first lift comprising:

a first wire facing having a first horizontal element and a first vertical facing, the first horizontal element having initial and terminal wires coupled to a plurality of horizontal wires, and the first vertical facing comprising:

a plurality of first vertical wires coupled to a plurality of facing cross wires including a last facing cross wire and a top-most cross wire; and a plurality of first connector leads extending from the first horizontal element and up the first vertical facing, each first connector lead comprising two vertical wires of the plurality of first vertical wires, the two vertical wires of the plurality of first vertical wires being laterally offset from each other by a short distance;

a first soil reinforcing element detachably coupled to the first wire facing, the first soil reinforcing element having converging lead ends coupled to a first coil and at least a portion of the first soil reinforcing element extends from the first horizontal element;

a first threaded rod extended between the two vertical wires of a first connector lead of the plurality of first connector leads and through the first vertical facing and the first coil, wherein a first washer disposed radially about the first threaded rod engages the first vertical facing and prevents the first threaded rod from passing completely therethrough and a first nut is threaded onto the first threaded rod to prevent its removal from the first coil; and backfill disposed on the first wire facing to a first height above the last facing cross wire of the first vertical facing; and a second lift disposed on the backfill of the first lift, the second lift comprising:

a second wire facing having a second horizontal element and a second vertical facing, the second vertical facing comprising:

a plurality of second vertical wires and a plurality of second connector leads extending from the second horizontal element and up the second vertical facing, each second connector lead comprising two vertical wires of the plurality of second vertical wires, the two vertical wires of the plurality of second vertical wires being laterally offset from each other by a short distance;

a second soil reinforcing element detachably coupled to the second wire facing, the second soil reinforcing element having converging lead ends coupled to a second coil and at least a portion of the second soil reinforcing element extends beyond an end portion of the second horizontal element; and a second threaded rod extended between the two vertical wires of a second connector lead of the plurality of second connector leads and the two wires of the first connector lead and through the first and second vertical facings and the second coil, wherein a second washer disposed radially about the second threaded rod engages the first vertical facing and prevents the second threaded rod from passing therethrough and a second nut is threaded onto the second threaded rod to prevent its removal from the coil.

15. The structure of claim 14, wherein the first and second threaded rods are eye-bolts having a head and a non-threaded body portion extending a pre-determined distance from the head.

16. The structure of claim 15, wherein the eye-bolts further comprise a third nut threaded onto the eye-bolt up to the non-threaded portion and configured to laterally-offset the head of the eye-bolt the pre-determined distance from the first and second vertical facings.

17. The structure of claim 16, wherein the head is a loop configured to receive a length of rebar configured to form part of a facing structure.

18. The structure of claim 14, wherein the first lift further comprises a strut having a first end coupled to the first vertical facing and a second end coupled to the first horizontal element, the strut being configured to maintain the first vertical facing at a predetermined angle with respect to the first horizontal element.

19. The structure of claim 14, wherein the top-most cross wire of the first vertical facing is slidably engaged with the second vertical facing.

* * * * *